US008392139B2

(12) United States Patent
Jin

(10) Patent No.: US 8,392,139 B2
(45) Date of Patent: Mar. 5, 2013

(54) MULTI-POINT CALIBRATION METHOD FOR THE DEPTH OF A HORIZONTAL DIRECTIONAL DRILLING GUIDING INSTRUMENT

(75) Inventor: Jian Jin, Ningbo (CN)

(73) Assignee: Ningbo Golden Land Electronics Inc., Ningbo (CN)

( * ) Notice: Subject to any disclaimer, the term of this patent is extended or adjusted under 35 U.S.C. 154(b) by 264 days.

(21) Appl. No.: 12/760,436

(22) Filed: Apr. 14, 2010

(65) Prior Publication Data

US 2011/0098959 A1 Apr. 28, 2011

(51) Int. Cl.
*G06F 19/00* (2011.01)

(52) U.S. Cl. ..... 702/94

(58) Field of Classification Search ..... 702/94
See application file for complete search history.

(56) References Cited

U.S. PATENT DOCUMENTS

2010/0141261 A1* 6/2010 Overby et al. ..... 324/329

* cited by examiner

*Primary Examiner* — Tung S Lau
(74) *Attorney, Agent, or Firm* — Morrison & Foerster LLP

(57) ABSTRACT

A multi-point calibration method for the depth of a horizontal directional drilling guiding instrument comprises: maintaining a constant power output of a normal power transmitter in a specific power supply condition; selecting at least two depth calibrations; receiving a signal transmitted from a transmitter and an intensity of a signal at a depth calibration position by a receiving instrument; performing a signal shaping and an analog/digital conversion to the signal received by a signal receiving instrument; and entering the signal into a central digital signal processor, and performing a depth calibration by any compensation method to obtain a required measuring depth. The invention improves the accuracy of the depth measurement of the horizontal directional drilling guiding instrument by using a plurality of compensation methods to compensate any error caused by the electric fields and environmental noises and occurred in the depth measurement of horizontal directional drilling guiding instrument.

4 Claims, 1 Drawing Sheet

MULTI-POINT CALIBRATION METHOD FOR THE DEPTH OF A HORIZONTAL DIRECTIONAL DRILLING GUIDING INSTRUMENT

CROSS REFERENCE TO RELATED APPLICATIONS

This application claims priority to Chinese Patent Application No. 200910130862.5, filed on Apr. 16, 2009, which is hereby incorporated by reference in its entirely.

BACKGROUND OF THE INVENTION

1. Field of the Invention

The present invention relates to a technical area of depth measurements of a guiding instrument, and more particularly to a multi-point calibration method for the depth of a horizontal directional drilling guiding instrument.

2. Description of the Related Art

At an early stage, horizontal guiding instruments apply a dipole source and two antennas to measure the depth of a probe.

$$R=d/((s_1/s_2)^{\wedge 1/3}-1)$$

where, $s_1$ and $s_2$ are intensities of signals transmitted from a transmitter and received respectively by two detecting instruments having a one-dimensional antenna, and d is the distance between the two detecting instruments having the one-dimensional antenna. This depth measuring method usually has a relatively large depth error.

Another present existing method is a single-point calibration method that obtains a measured value $M_o$, provided that the distance ($k_0$) is known, and the depth (r) is calculated by the following equation:

$$r=(M_0/s)^{1/3}$$

where, s is the intensity of a signal transmitted from a transmitter and received by a measuring instrument, and this method provides a more accurate depth measurement, but the range of the accurate measurement is very narrow due to other factors such as the existence of electric fields and environmental noises. The accuracy will be increasingly lower after a certain specific depth is reached. The greater the distance, the greater is the error.

SUMMARY OF THE INVENTION

Therefore, it is a primary objective of the present invention to overcome the shortcomings of the prior art including the inaccuracy and the depth limitation of the conventional measuring method by providing a multi-point calibration method for the depth of a horizontal directional drilling guiding instrument.

To achieve the foregoing objective, the present invention provides a multi-point calibration method for the depth of a horizontal directional drilling guiding instrument, and the method comprises the steps of:

(1) maintaining a constant power output of a normal power transmitter in a specific power supply condition;

(2) selecting at least two depth calibrations;

(3) receiving a signal transmitted from a transmitter and an intensity of a signal at a depth calibration position by a receiving instrument;

(4) performing a signal shaping and an analog/digital conversion to the signal received by a signal receiving instrument; and (5) entering the signal into a central digital signal processor, and performing a depth calibration by any compensation method to obtain a required measuring depth.

The invention has the advantage of improving the accuracy of the depth measurement of a horizontal directional drilling guiding instrument by using compensation methods to compensate an error caused by the electric fields and environmental noises and occurred in the depth measurement of the horizontal directional drilling guiding instrument.

DETAILED DESCRIPTION OF THE PREFERRED EMBODIMENTS

Figure 1:
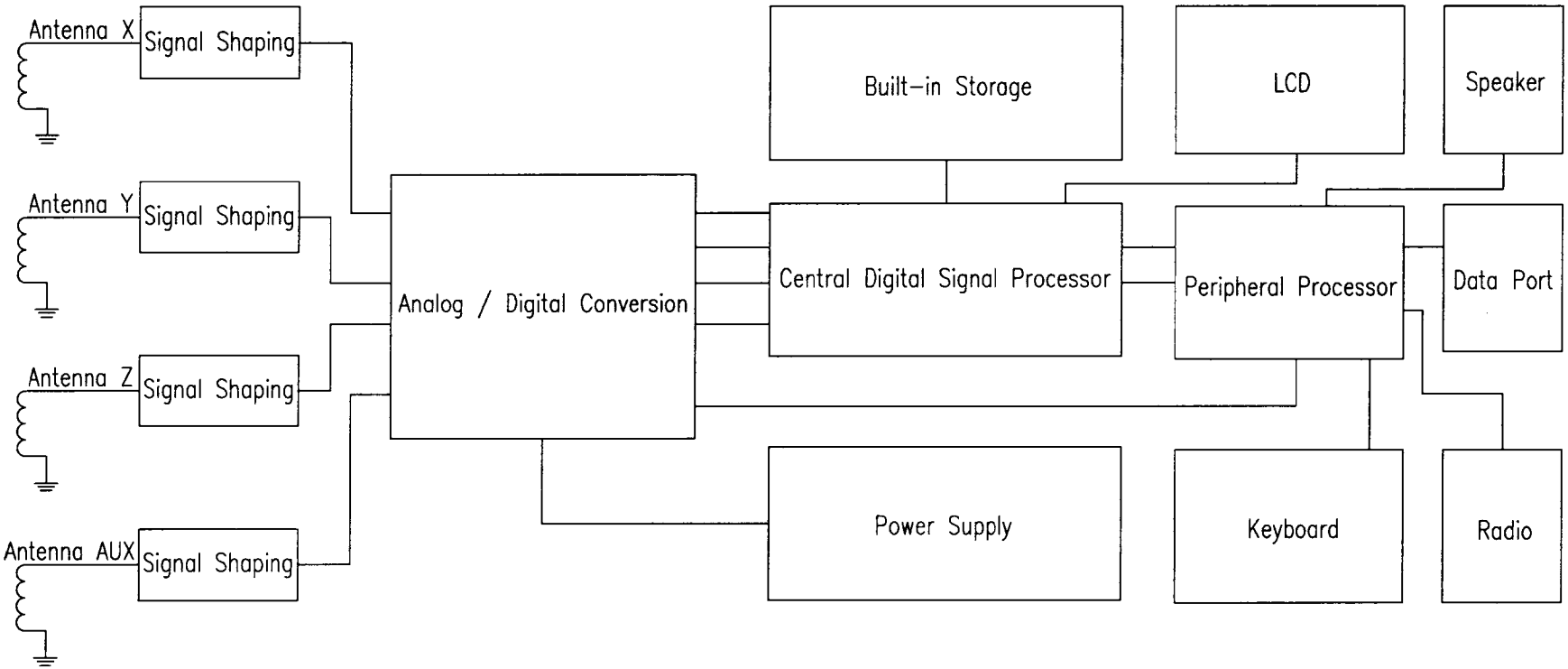
FIG. 1 is a block diagram of a receiving instrument used in a multi-point calibration method for the depth of a horizontal directional drilling guiding instrument in accordance with a preferred embodiment of the present invention.

A multi-point calibration method for the depth of a horizontal directional drilling guiding instrument in accordance with the present invention comprises the steps of:

(1) maintaining a constant power output of a normal power transmitter in a specific power supply condition;

(2) selecting two depth calibrations;

(3) receiving signals including a signal s at the position of the transmitter and two signals at two depth calibration points with intensities of $s_1$, $s_2$ respectively by the receiving instrument, wherein the default value of the distance of the first calibration point $s_1$ from the transmitter is equal to 3 meters, and the default value of the distance of the second calibration point $s_2$ from the transmitter is equal to 10 meters, provided that two-point calibration is adopted;

(4) performing a signal shaping and an analog/digital conversion to the signals s, $s_1$, $s_2$ received by the receiving instrument (as shown in FIGS. 1); and (5) entering the signal s, $s_1$, $s_2$ into a central digital signal processor after the analog/digital conversion takes place, and performing a depth calibration by a linear compensation method to obtain a required measured depth, wherein the central digital signal processor perform a calculation according to the equation of:

$$r=(M_0/s)^{1/3}+[(M_0/s)^{1/3}-5]\times k$$

where, r is the measuring depth, and $M_0$ is the measured value, and s is the intensity k of the signal transmitted from the transmitter and received by the receiving instrument, and the value of k is obtained by the equation of:

$$k=[10-(M_0/s_2)^{1/3}]/[(M_0/s_2)^{1/3}-5]$$

where, $M_0$ is the measured value, and $s_2$ is the intensity of a signal occurred at the second calibration point and received by the receiving instrument, and the measured value $M_0$ is calculated by the equation of:

$$M_0=s_1\times R^3$$

where, s1 is the intensity of a signal occurred at the first calibration point and received by the receiving instrument, and R is the distance of the first calibration point from the transmitter and has a default value of 3 m.

What is claimed is:

1. A multi-point calibration method for the depth of a horizontal directional drilling guiding instrument, comprising the steps of:

(1) maintaining a constant power output of a power transmitter in a specific power supply condition;

(2) selecting at least two depth calibrations;

(3) receiving a signal transmitted from a transmitter and an intensity of a signal at a depth calibration position by a receiving instrument;

(4) performing a signal shaping and an analog/digital conversion to the signal received by a signal receiving instrument; and (5) entering the signal into a central digital signal processor, and performing a depth calibration by any compensation method to obtain a required measuring depth;

wherein the compensation method includes a linear compensation method, the linear compensation method is implemented by the equation of:

$$r=(M_0/s)^{1/3}+[(M_0/s)^{1/3}-5]\times k$$

where, r is the measuring depth, and $M_0$ is the measured value, and s is the intensity k of the signal transmitted from the transmitter and received by the receiving instrument, and the value of k is obtained by the equation of:

$$k=[10-(M_0/s_2)^{1/3}]/[(M_0/s_2)^{1/3}-5]$$

where, $M_0$ is the measured value, and $s_2$ is the intensity of a signal occurred at the second calibration point and received by the receiving instrument.

2. The multi-point calibration method for the depth of a horizontal directional drilling guiding instrument as recited in claim 1, wherein the calibration points includes a first calibration point $s_1$ and a second calibration point $s_2$ used for carrying out a compensation method.

3. The multi-point calibration method for the depth of a horizontal directional drilling guiding instrument as recited in claim 1, wherein the measured value $M_0$ is calculated by the equation of:

$$M_0=s_1\times R^3$$

where, $s_1$ is the intensity of a signal occurred at the first calibration point and received by the receiving instrument, and R is the distance of the transmitter from the first calibration point.

4. The multi-point calibration method for the depth of a horizontal directional drilling guiding instrument as recited in claim 2, wherein the compensation method includes a linear compensation method.

* * * * *